US006594933B2

(12) United States Patent
Attia et al.

(10) Patent No.: US 6,594,933 B2
(45) Date of Patent: Jul. 22, 2003

(54) PARTIAL FOLD PRINTABLE TAB PRODUCT

(75) Inventors: Omar S. Attia, Lakeview, NY (US); Donald R. Miller, West Falls, NY (US); Andre M. Saint, Tonawanda, NY (US); Jay K. Sato, Mission Viejo, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/952,929

(22) Filed: Sep. 15, 2001

(65) Prior Publication Data

US 2003/0051383 A1 Mar. 20, 2003

(51) Int. Cl.[7] ..... G09F 23/10

(52) U.S. Cl. ..... 40/641; 40/359; 40/360; 283/41

(58) Field of Search ..... 40/359, 360, 641; 283/39, 41, 36; 402/79

(56) References Cited

U.S. PATENT DOCUMENTS

| | | | | |
|---|---|---|---|---|
| 3,314,529 A | | 4/1967 | Glowiak | |
| 3,473,827 A | | 10/1969 | Leadbetter | |
| 4,951,408 A | * | 8/1990 | Banks | 40/641 |
| 4,962,603 A | * | 10/1990 | Kao et al. | 40/641 |
| 4,972,615 A | | 11/1990 | Grant | |
| 5,182,152 A | * | 1/1993 | Ericson | 40/360 X |
| 5,462,783 A | * | 10/1995 | Esselmann | 40/641 X |
| 5,662,976 A | | 9/1997 | Popat et al. | |
| 5,924,227 A | * | 7/1999 | Sommers | 40/360 |
| 6,013,154 A | | 1/2000 | Thomas-Cote | |
| 6,086,107 A | | 7/2000 | Whistler et al. | |
| 6,132,831 A | | 10/2000 | Thomas-Cote | |

FOREIGN PATENT DOCUMENTS

| | | |
|---|---|---|
| GB | 1242619 | 9/1968 |
| GB | 2006683 A | 5/1979 |

* cited by examiner

*Primary Examiner*—Joanne Silbermann
(74) *Attorney, Agent, or Firm*—Oppenheimer Wolff & Donnelly LLP

(57) ABSTRACT

An index tab assembly may include a liner sheet with an adhesive releasing surface and an overlying plastic sheet with die cut partial fold tabs therein, and with a layer of pressure sensitive adhesive between the two sheets. The tabs include two printable areas of substantially equal size and a securing area extending from one of the printable areas. The securing area has a narrow strip area adjacent the printable area which is free from adhesive. In use, the tabs are removed from the liner, the two printable areas are folded together, and the resultant step or lip and the adhesive free area cooperate to facilitate accurate placement of the index tab.

22 Claims, 3 Drawing Sheets

FIG. 2
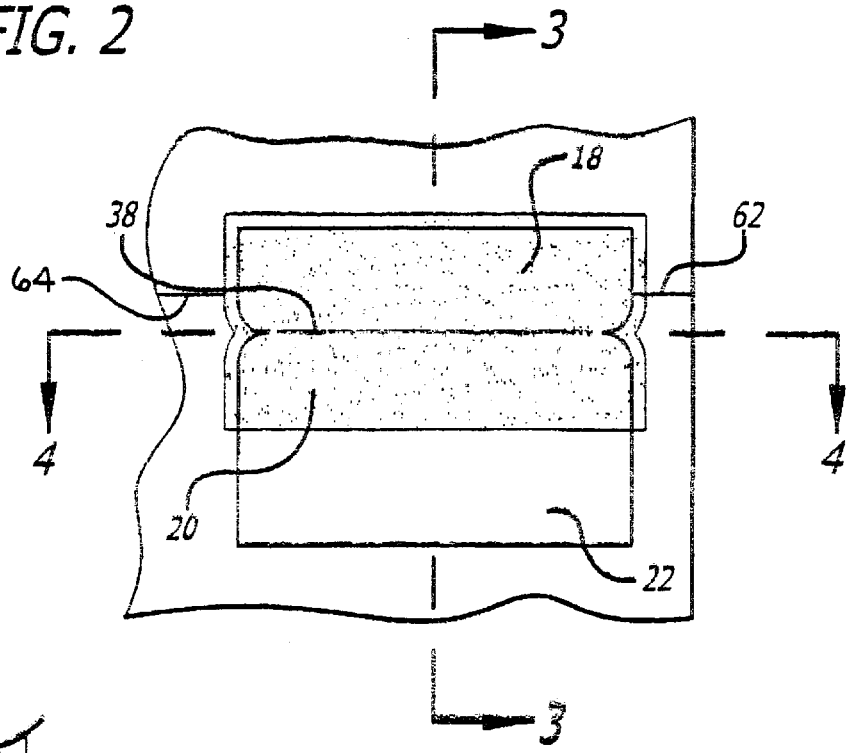
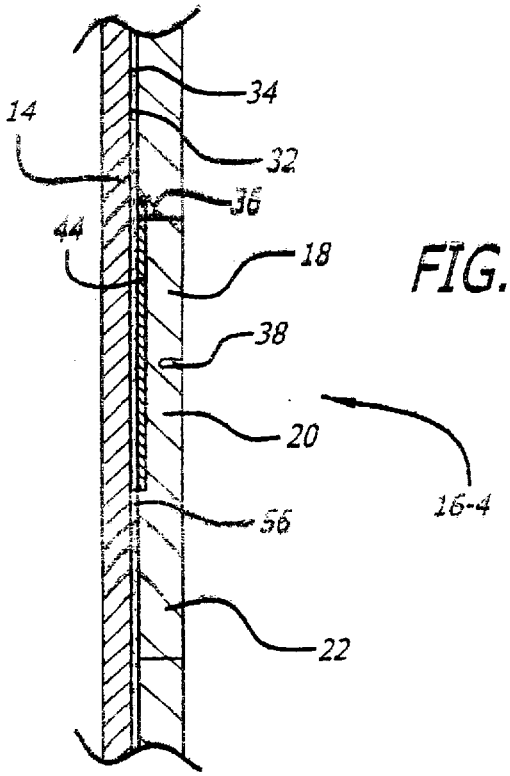
FIG. 3
FIG. 4
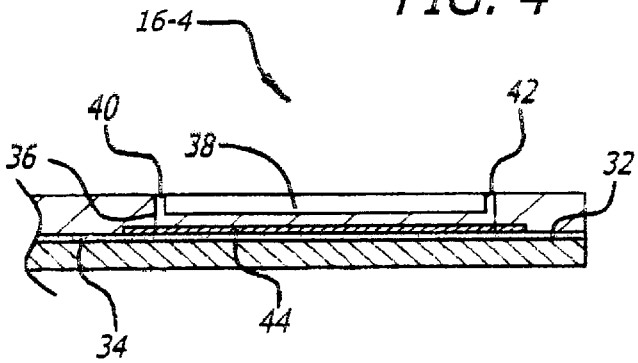

PARTIAL FOLD PRINTABLE TAB PRODUCT

FIELD OF THE INVENTION

This invention relates to index tabs, and more particularly to self adhesive index tabs that can be attached by the user to the edge of sheets.

BACKGROUND OF THE INVENTION

Many index tab constructions have been proposed heretofore, and some of the prior patents in this field include the following: U.S. Pat. No. 3,314,529; U.S. Pat. No. 3,473,827; U.S. Pat. No. 4,972,615; U.S. Pat. No. 5,662,976; U.S. Pat. No. 6,086,107; U.S. Pat. No. 6,013,154; U.S. Pat. No. 6,132,831; Great Britain Patent No. 2,006,683A; and Great Britain Patent No. 1,212,619.

However, the tabs and tab sheets which have been proposed heretofore are subject to various problems. For example, when a polyester sheet is laminated to a paper liner, and is stored for a time prior to printing in a laser or ink jet printer, certain problems may arise. If the tabs on the polyester sheet have a free edge, they may fold outward and interfere with smooth rapid feeding of the sheets through the printer; and paper jams may occur. In addition, under high humidity conditions curling of the sheets may occur. Further, if the matrix of polyester around the tabs is removed, release material on the liner may engage the printer rollers and may cause feeding problems.

In addition, with prior art tabs, it is often difficult to locate the tabs accurately on the edge of the sheet material to which the tab is to be fastened.

SUMMARY OF THE INVENTION

In accordance with one illustrative embodiment of the invention, sheets of index tabs may include a liner sheet and an overlying plastic sheet, preferably of translucent polyester, with the index tabs being die cut through the plastic sheet. The liner sheet has a release surface, and a layer of pressure sensitive adhesive is located between the two sheets, except for certain non-adhesive strip areas. The sheets may be letter size, 8½×11 inches, or A-4 paper size, or have other dimensions.

The index tabs have three areas, including first and second printable areas of approximately equal size, and a securing area extending from one of the printable areas. A score line is provided between the two printable areas to facilitate folding them over against each other, with two full thickness ties at the ends of the score line. A narrow strip area free of adhesive is located on the securing area next to the adjacent printable area.

After the sheets are printed, preferably with the die cut tabs and the entire plastic sheet intact, a printed tab may be removed, and the two adhesive coated printable areas are folded together. This forms a lip or step immediately adjacent the adhesive free strip area. The index tab is then attached to the edge of sheet material, with the lip or step being placed against the edge of the sheet material, and with any needed slight adjustments being facilitated by the adhesive free area; and then the adhesive coated securing area is pressed onto the sheet to accurately secure the tab in position.

Concerning other aspects or features of the invention, the tabs are preferably formed of translucent plastic material such as polyester.

When the sheets are being printed, with indexing information, the full plastic sheet including the matrix around the die cut tabs is fed through the printer. Cuts may be provided in the plastic sheet from the edges of the plastic sheets to the die cut tabs and between the die cut tabs, to avoid curling of the two layer sheet assemblies, which might otherwise occur as a result of non-uniform moisture absorption.

The plastic sheet material is preferably treated to receive a coating, normally a colored coating such as colored ink, to form a suitable background for printing indexing information on the tabs, using a laser ink jet printer or by any known printing method. The colored coating is preferable on the side of the plastic sheet to which the adhesive is applied, facing the liner, but may be on the outer surface of the plastic sheets.

It is to be understood that the tabs per se could be sold individually rather than on letter size sheets, or in strip format, for examples.

Other objects, features and advantages of the invention will become apparent from a consideration of the following detailed description and from the accompanying drawings.

BRIEF DESCRIPTION OF THE DRAWINGS

FIG. 2 is an enlarged showing of one of the index tabs along with a portion of the sheet assembly of FIG. 1;

FIG. 3 is a cross sectional view taken along lines 3—3 of FIG. 2;

FIG. 4 is a cross sectional view taken along lines 4—4 of FIG. 2;

DETAILED DESCRIPTION OF THE PREFERRED EMBODIMENTS

Figure 1:
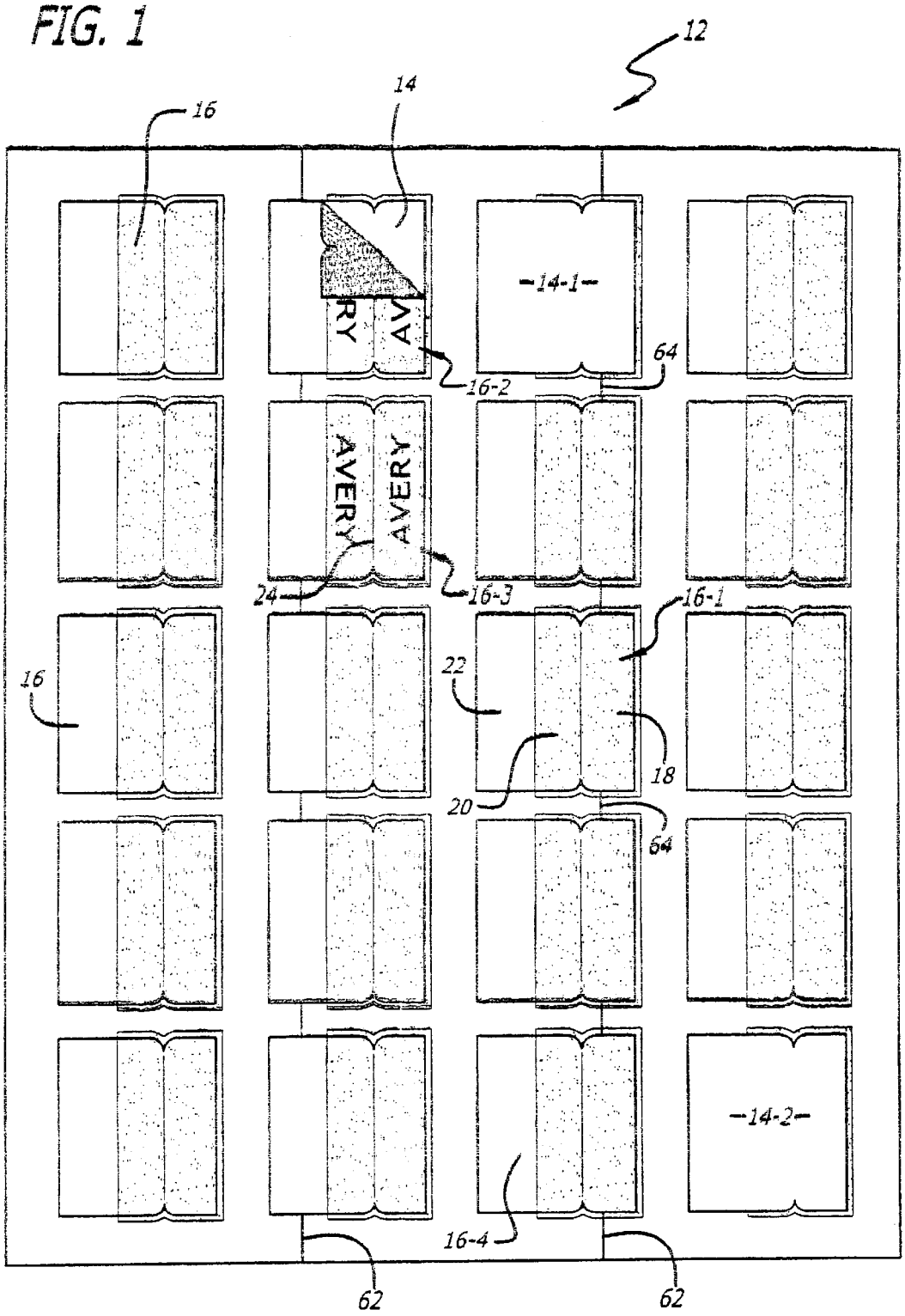
FIG. 1 represents a two sheet assembly showing index tabs mounted on a liner or backing sheet, and illustrating the principles of the invention.

Referring more particularly to the drawings, FIG. 1 shows a two layer assembly 12 which includes a liner sheet 14 to which a large number of index tabs 16 are secured. At the location designated 14-1 and 14-2 the index tabs have been removed, and accordingly, the underlying liner or support sheet 14 may be seen in the showing of FIG. 1. Each of the index tabs such as the index tab 16-1 includes a first printable area 18, a second printable area 20, and a securing area 22. The printable areas 18 and 20 are provided with a coating or treatment on the exposed surface to make the areas more ink or toner receptive. The underlying liner 14 is provided with a release surface; and a layer of adhesive is provided between the index tab layer, which may be plastic sheet material such as polyester (which may have an opaque coating thereon), and the underlying substrate or liner 14.

Reference is now made to index tab 16-2 which has index information printing on the two printable areas, and which is in the process of being removed from the backing sheet 14.

Referring now to the index tab 16-3 it may be noted that it has a score line 24 between the two printable areas so that, upon removal, the two printable areas may be folded together and the index tab may be therefore read from two directions. A score line in this location is also present in the other index tabs on the sheet.

Referring now to FIG. 2 of the drawings, an enlarged showing of one of the index tabs 16-4, is presented. In FIG. 2, the two printable areas 18 and 20 may be noted, along with the securing area 22 which is to be adhesively secured to the edge of a sheet where the index tab is to be located.

For convenience, reference will now be made to FIGS. 3 and 4 of the drawings which are cross sectional views taken along lines 3—3, and 4—4, respectively, of FIG. 2. In each case, the index tab 16-4 is shown mounted on the liner 14 which has a slick upper surface 32 which may be provided through the use of a release layer such as a silicone on the surface 32 or by the use of machine grade siliconized paper. A layer of adhesive, preferably pressure sensitive adhesive, 34 is located between the liner 14 and the plastic sheet material 36 of the index tab, in order to hold the two portions 18 and 20 together, when folded, and to hold the securing portion or area 22 to the sheet where the index tab is finally mounted. Other adhesives, such as permanent pressure sensitive adhesive, or water activated adhesives, may be used.

As shown in FIG. 3, the index tab 16-4 is provided with a score line 38 to facilitate folding the two printable areas 18 and 20 together. The cross sectional view of FIG. 4 is taken along the score line and shows the score line 38, with two ties 40 and 42 at the ends of the score line to help avoid accidental ripping of the index tab along the score line as the index tab is being removed from the underlying liner sheet 14.

Concerning one other minor matter, it may be noted that a broad substantially opaque area, layer 44 is provided on the two printable areas 18 and 20 of the index tab between the plastic sheet material 36 and the liner 14. This opaque layer provides an opaque background for the index information printing on the two printable areas 18 and 20. The layer 44 is preferably located as shown in FIGS. 3 and 4, but may be on the outer exposed surface of the printable areas.

Figure 6:
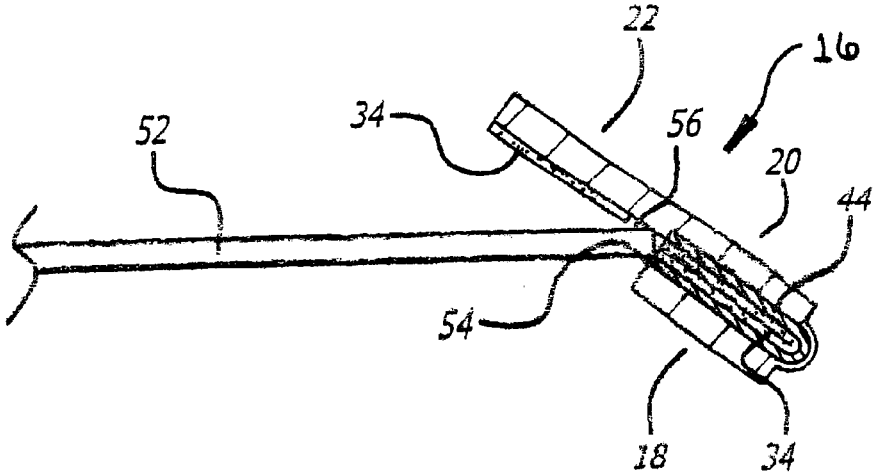
FIG. 6 illustrates the method of securing an index tab to the edge of a sheet, with arrangements to ensure accurate and convenient location of the tab, illustrating one aspect of the principles of the invention.

Incidentally, in order for convenience of disclosure, the thicknesses of the various layers as shown in FIGS. 3, 4, and 6 are somewhat exaggerated, and the actual layers would be somewhat thinner. More specifically, the liner 14 would normally be about two to four thousandths of an inch thick and the plastic layer 36 would be of similar thickness. More generally, various thicknesses of the liner and the plastic layer may be used, but it is desirable that the entire sheet assembly of FIG. 1 be not more than about 0.012 or 0.015 of an inch thick for convenience in feeding through a laser or an ink jet printer.

Figure 5:
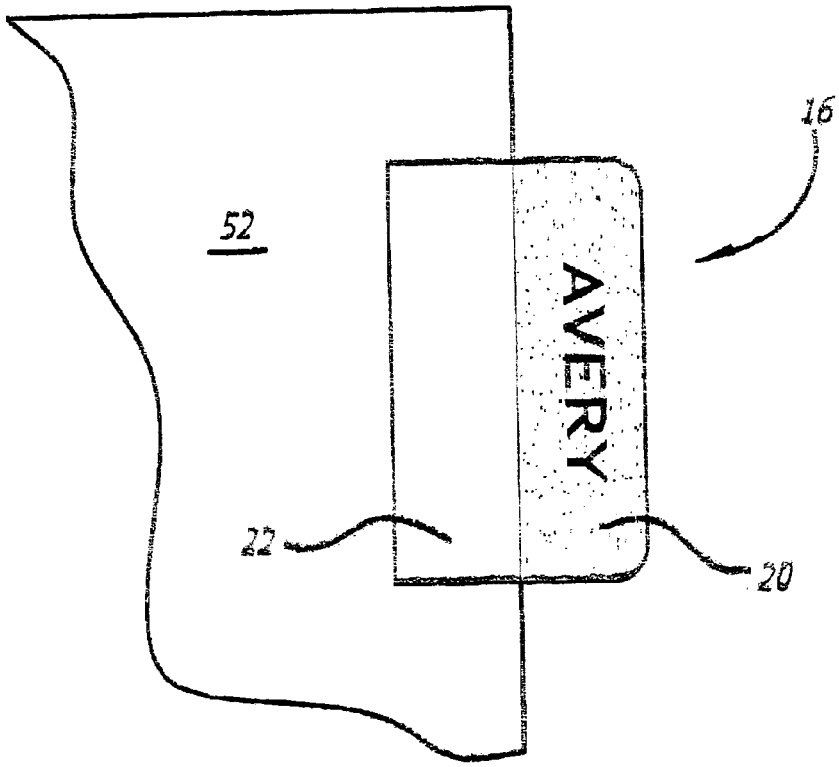
FIG. 5 is a fragmentary view of a sheet with an index tab attached thereto.

Referring now to FIG. 5 of the drawings, the reference numeral 52 refers to the corner of a sheet to which the index tab 16 is secured. Visible in FIG. 5 is the printed surface 20 and the securing area 22 which holds the index tab 16 to the sheet 52.

FIG. 6 shows the application of an index tab 16 to a sheet 52. Visible in FIG. 6 is the securing area 22 and the adhesive 34 which is on the underside of the securing area 22. The two printable areas 18 and 20 have been folded over against one another to provide a shoulder or a lip 54 which can engage the outer edge of the sheet 52 to assist in the location of the index tab precisely on the edge of the sheet 52.

In addition, as shown in FIGS. 3 and 6, there is a narrow strip area 56 which is free of adhesive and which also serves to assist in the proper location of the tab 16 on the edge of the sheet 52 as shown in FIG. 6. This adhesive free area 56 avoids premature contact of the adhesive 34 with the edge of the sheet 52, and thus facilitates accurate location of the index tab 16.

Concerning one other minor matter, the sheet assembly 12 of FIG. 1 is provided with die cuts through the upper plastic sheet material, as indicated at the reference numerals 62 which appear in FIGS. 1 and 2. These cuts 62 which extend to the die cuts forming the tabs, allow the plastic sheet material to expand with the liner as the liner absorbs ambient moisture, and thus avoid curling or warping of the sheet assemblies. It may also be noted that similar cuts 64 extend between adjacent tabs 16. The cuts 62 and 64 area preferably aligned parallel with the grain of the paper liner.

It may also be noted that the tabs 16 may be different colors, for convenience in providing special indexing arrangements desired by customers for certain specific purposes. Additionally, in FIG. 1, it may be noted that the sheet is overprinted in the printable areas of the index tabs, leaving a residual coating around the areas 14-1 and 14-2 of FIG. 1, where tabs have been removed. This overprinting assures full coverage of the printable coating on the printable areas 18 and 20 of the tabs.

In the preparation of the assembly of FIG. 1, the translucent polyester sheet material may be initially printed over the entire printable areas with colored ink, and then with white opaque ink for opacity, and subsequently with an adhesive layer in the areas described above. The sheet material is then combined with the layer of liner material, and thereafter the tabs are die cut and scored. Incidentally, the outer exposed surface of the polyester material may be specially treated or coated to enhance receptivity to printing by laser or ink jet printers, and/or for writing by pencil or pen, as detailed hereinbelow. It is also noted that the overall ink coating for opacity and color may be on the top exposed side of the polyester material or preferably on the underside as described hereinabove.

Concerning other aspects of the preferred embodiments of the invention, the liner is preferably made of machine finished grade siliconized paper, although it could be calendared paper coated with a thin layer of silicone. The adhesive is preferably a rubber based hot melt adhesive, and is removable or repositionable adhesive. Other adhesives may be used, including acrylic pressure sensitive adhesives for one example. Concerning the thickness of the adhesive coating, it is preferably about one mil thick, but may be from about 0.0005 to 0.0015 inch in thickness. Regarding the background broad area coating on the underside of the printable areas, this may be accomplished using what is known as flexo-ink, or water based ink for flexographic printing processes. Other coatings may be employed to provide an opaque background for the letter or number printing to be applied to the printable areas of the tabs. The total thickness of the tab sheet assemblies in one preferred embodiment was about 8 mils, but somewhat greater or lesser thicknesses could be used, with a thickness more than about 12 or 15 thousandths of an inch being undesirable as being too thick for easy feeding through laser or ink jet printers. With regard to the ink receptive quality of the plastic sheet material various methods are known to make the surface ink receptive and these may involve treatment such as by high voltage, for example, or coating with an ink receptive coating. Polyester plastic sheet material pretreated to be ink receptive is available from Mitsubishi, of Greer, S.C., as Hostaphan® 4IJL film. A coating which may be employed for the upper surface for receiving laser or ink jet printing or writing, is disclosed in U.S. patent application Ser. No. 09/726,196, filed Nov. 29, 2000, and comprises a mixture of polyvinyl pyrrolidone, silica, and a chromium complex capable of crosslinking polyvinyl pyrrolidone.

It is further noted with respect to FIG. 1 of the drawings that the adhesive between the upper plastic sheet and the liner 14 is preferably spaced back from the edges of the sheet, by a few thousandths of an inch, leaving a very narrow adhesive free zone around all four edges of the sheet. This will avoid possible contamination of printers which might otherwise occur as a result of adhesive oozing out from the two layer assembly under applied heat and pressure which may occur during printing.

It is to be understood that the foregoing detailed description and the accompanying drawings relate to one preferred embodiment of the invention. Various changes and modifications may be made without departing from the spirit and scope of the invention. Thus, by way of example and not of limitation, instead of being rectangular, the tabs may have other shapes. In addition, the two sheet materials as identified above, are preferred, but other sheet materials may be employed, including specifically a high strength paper for the tabbed materials. It may also be noted that the lip may be formed by a partially folded over tab area, or by a supplemental layer overlying a printable portion of the said tab. Regarding the score line, it may be in the form of a partial die cut part way through the plastic sheet material, or in the form of a line of perforations, for examples. Concerning the substantial opacity of the printable areas of the tabs, the sheet plastic may be substantially opaque; and if opaque colored ink is used, the additional opaque white ink may not be needed. Also, if the opaque layer is on the exposed surface of the tab, it would be preferable to apply the white ink first, and then a layer of colored ink. With regard to adhesives, while repositionable pressure sensitive adhesive is preferred, other adhesives may be used, including permanent pressure sensitive adhesives, or water activated adhesives, for examples. Accordingly, the present invention is not limited to the precise constructions shown in the drawings and described in detail hereinabove.

What is claimed is:

1. A partial fold printable tab assembly comprising:

a plastic sheet tab having three areas, including first and second printable areas of substantially equal size, and a securing area extending from the first one of said printable areas;

said tab having a front side and a back side with the back side having an adhesive coating over at least a portion of said back side;

a score line separating said first and second printable areas whereby said first and second printable areas may be printed and then folded over against each other; with the adhesive on the back side of said second printable area fully engaging the back side of the first printable area to form a step for engaging the edge of a sheet to which the tab is to be secured;

two ties of full thickness of said sheet, one of said ties being located at each end of said score line at the edges of said tab, to avoid ripping said tab apart along said score line;

said adhesive coating extending over said back side of said tab except for a narrow adhesive free area extending across the full width of said tab along the side of said securing area next to the adjacent printable area, to facilitate securing the two printable areas together overlapping one another, and to facilitate accurate mounting of said tab on the edge of sheet material at the resultant step; and the exposed surfaces of said printable areas being receptive to printing from an ink jet or laser printer, or writing by pen or pencil.

2. A partial fold printable tab assembly including a plurality of tabs as defined in claim 1 mounted on a liner sheet which has an adhesive releasing surface.

3. A partial fold printable tab assembly as defined in claim 1 wherein said plastic sheet tab is translucent.

4. A partial fold printable tab assembly as defined in claim 1 wherein said printable areas are provided with a substantially opaque coating.

5. A partial fold printable tab assembly as defined in claim 1 wherein said tabs are formed of polyester.

6. A partial fold printable tab assembly as defined in claim 1 wherein said adhesive is a repositionable pressure sensitive adhesive.

7. A printable index tab assembly comprising:

a liner sheet having an adhesive releasing surface, and a size of about 8½ by 11 inches or A-4 size;

a thin plastic sheet overlying said liner sheet and adhered thereto by a layer of pressure sensitive adhesive;

said thin plastic sheet being die cut into a plurality of index tabs, each of said index tabs having first and second printable areas which are substantially equal in size, and a securing area extending from the first one of said printable areas;

said two printable areas being divided by a score line, to facilitate folding said printable areas together;

the second of said printable areas defining an edge of said tab for folding over and fully adhesively engaging the first printable area to define a step; and a non-adhesive coated thin strip area extending across said tab along one side of said securing area adjacent one of said printable areas.

8. An assembly as defined in claim 7 further comprising die cuts from the edge of said plastic sheet and between said index tabs to avoid curling of said assemblies.

9. An assembly as defined in claim 7 wherein a substantially opaque layer is provided on said two printable areas.

10. A partial fold printable tab assembly comprising:

an index tab having three areas, including first and second printable areas of substantially equal size, and a securing area extending from only one of said printable areas;

a line of weakness separating said first and second printable areas whereby said first and second printable areas may be printed and then folded over against each other to form a step;

an adhesive coating extending substantially over one side of said tab to facilitate securing the two printable areas together overlapping one another, thereby forming a step to facilitate accurate mounting of said tab on the edge of sheet material; the only exposed adhesive being on said securing area and being limited to one side of said tab when said tab is folded and ready for application; and the exposed surfaces of said printable areas being receptive to printing from an ink jet or laser printer.

11. A partial fold printable tab assembly including a plurality of tabs as defined in claim 10 mounted on a liner sheet which has an adhesive releasing surface.

12. A partial fold printable tab assembly as defined in claim 10 wherein said index tab is translucent.

13. An assembly as defined in claim 10 wherein said adhesive coating has a narrow adhesive free area extending substantially across said tab next to the adjacent printable area.

14. A tab assembly as defined in claim 10 further comprising index information printing on both of said first and second printable areas on opposite sides of said tab.

15. An accurately mountable printable tab assembly comprising:

a plastic sheet tab having a printable area and a securing area extending from said printable area;

said tab having a step on said printable area adjacent said securing area;

an adhesive coating extending over one side of said tab except for a narrow adhesive free area extending substantially across said tab along the side of said securing area adjacent said printable area to facilitate accurate mounting of said tab on the edge of sheet material;

the only exposed adhesive being on said securing area and being limited to one side of said tab when said tab is folded and ready for application to the edge of sheet material; and the exposed surfaces of said printable areas being receptive to printing from an ink jet or laser printer, or writing from a pen or pencil.

16. A tab assembly as defined in claim 15 wherein said step is formed by folding over said printable area.

17. A partial fold printable tab assembly including a plurality of tabs as defined in claim 15 mounted on a liner sheet which has an adhesive releasing surface.

18. A tab assembly as defined in claim 17 wherein said assembly includes a liner sheet and a plastic sheet overlying said liner sheet with an adhesive layer between the two sheets, said assembly being approximately letter size or about 8½ by 11 inches or A-4 paper size in dimensions.

19. A tab assembly as defined in claim 17 wherein said tabs are die cut into a plastic sheet overlying said liner sheet, and wherein additional die cuts extend from the edges of said plastic sheets to the die cut tabs, and therebetween.

20. A tab assembly as defined in claim 17 wherein said printable area is provided with a broad area substantially opaque coating to provide a light colored background for the printing of index information on said printable area.

21. A partial fold printable tab assembly as defined in claim 15 wherein said plastic sheet tab is translucent.

22. An assembly comprising:

an index tab having three areas, including first and second printable areas of substantially equal size, and a securing area extending from one of said printable areas;

a line of weakness separating said first and second printable areas whereby said first and second printable areas may be printed and then folded over against each other;

an adhesive coating extending substantially over one side of said tab to facilitate securing the two printable areas together overlapping one another, thereby forming a lip to facilitate accurate mounting of said tab on the edge of sheet material; the only exposed adhesive being on said securing area when said tab is folded and ready for application; and a sheet for receiving said tab on an edge thereof;

said tab being secured to said sheet on only one side of said sheet with said securing area engaging said one side of said sheet and said lip engaging the edge of said sheet; and a narrow adhesive-free area extending substantially across said securing area immediately adjacent said edge of said sheet.

* * * * *